US008413363B1

(12) United States Patent
Karfiol et al.

(10) Patent No.: US 8,413,363 B1
(45) Date of Patent: Apr. 9, 2013

(54) FIRING PIN STOP DISENGAGEMENT MECHANISM AND METHOD OF REMOVING FIRING PIN USING THE FIRING PIN STOP DISENGAGEMENT MECHANISM

(75) Inventors: Yury Karfiol, Brooklyn, NY (US); John Goliber, Leonia, NJ (US)

(73) Assignee: Kimber IP, LLC, Yonkers, NY (US)

( * ) Notice: Subject to any disclaimer, the term of this patent is extended or adjusted under 35 U.S.C. 154(b) by 320 days.

(21) Appl. No.: 12/987,521

(22) Filed: Jan. 10, 2011

(51) Int. Cl.
*F41C 27/00* (2006.01)

(52) U.S. Cl.
USPC ..... 42/106; 42/69.01

(58) Field of Classification Search ..... 42/69.01, 42/69.02, 69.03, 14, 16, 17, 18, 20, 21, 16.1, 42/7, 108, 106; 89/194, 195, 196
See application file for complete search history.

(56) References Cited

U.S. PATENT DOCUMENTS 2,846,925 A * 8/1958 Norman ..... 89/145
4,608,909 A * 9/1986 Peters ..... 89/196
7,140,141 B2 * 11/2006 Vaid ..... 42/108
2005/0229459 A1 * 10/2005 McGarry ..... 42/7
2009/0071053 A1 * 3/2009 Thomele et al. ..... 42/1.01

FOREIGN PATENT DOCUMENTS

EP 319261 A1 * 6/1989

* cited by examiner

*Primary Examiner* — Jonathan C Weber
(74) *Attorney, Agent, or Firm* — Caesar, Rivise, Bernstein, Cohen & Pokotilow, Ltd.

(57) ABSTRACT

A firing pin stop disengagement mechanism is provided to aid in removal of the firing pin stop for a pistol. The mechanism includes a firing pin mechanism having a plunger having a groove and a rear end, and a pivoting lever having a first end having a pawl to engage the radial groove and rear end and a second end. The second end has an exposed surface to receive a force to raise the pawl from away from the plunger. When the disengagement mechanism is in a locked position, the pawl is engaged in the radial groove and the plunger is seated in an aperture in the stop. When the disengagement mechanism is in an unlocked position, the pawl is engaged on the rear end of the plunger, and the plunger is displaced toward the firing pin such that the plunger is disengaged from the aperture in the stop.

10 Claims, 10 Drawing Sheets

FIRING PIN STOP DISENGAGEMENT MECHANISM AND METHOD OF REMOVING FIRING PIN USING THE FIRING PIN STOP DISENGAGEMENT MECHANISM

BACKGROUND OF THE INVENTION

The present invention is directed generally to semi-automatic firearms. More specifically, the present invention is directed to firing pin stops for semi-automatic handguns.

A semi-automatic pistol that utilizes a firing pin located in the slide of the pistol must have a firing pin assembly that is removable for cleaning, replacement and repair. To remove the firing pin assembly, typically, the slide is removed from the frame of the pistol and a firing pin stop, or "back door," located at the rear end of the slide, is removed to gain access to the firing pin assembly.

However, since the firing pin spring of the firing pin assembly is held in compression by the firing pin stop and a plunger at the rear of the firing pin assembly engages an aperture in the firing pin stop, removal of the stop requires a difficult set of maneuvers wherein the plunger is pressed forward toward the barrel to compress the firing pin spring, while, simultaneously, the firing pin stop is moved in its guides in an upward direction, perpendicular to the firing pin. Additionally, as the firing pin stop moves out of its seated position, the firing pin assembly, including firing pin, spring and plunger are all under the compressive force of the spring. Great care must be taken while sliding the firing pin stop out of its seated position to ensure that the various elements of the firing pin assembly are not inadvertently shot out from their positions in the slide, causing possible injury to eyes or face of the person performing such firearm maintenance.

It would be desirable to provide a mechanism that avoids these drawbacks that is easy to operate, assemble and disassemble. It would also be desirable to provide such a mechanism that eliminates unexpected stripping of the firing pin stop from the slide during shooting.

All references cited herein are incorporated herein by reference in their entireties.

BRIEF SUMMARY OF THE INVENTION

In a preferred embodiment of the present invention, a firing pin stop disengagement mechanism for an automatic pistol is provided. The automatic pistol has a firing pin assembly mounted in a slide that is secured in the slide by the firing pin stop. The firing pin assembly includes a firing pin, a plunger and a firing pin spring secured between the firing pin and the plunger. The firing pin stop disengagement mechanism includes the plunger having a radial groove and a rear end. A pivoting lever is provided having a first end having a pawl to engage the radial groove of the plunger and the rear end of the plunger, a second end biased by a lever spring to cause the first end to move downward toward the plunger, and a pivot point located between the first end and the second end. The second end has an exposed surface adapted to receive a force by a user to raise the pawl from away from the plunger. When the firing pin stop disengagement mechanism is in a locked position, the pawl is engaged in the radial groove and the plunger is seated in an aperture in the firing pin stop and the firing pin is properly positioned for firing. When the firing pin stop disengagement mechanism is in an unlocked position, the pawl is engaged on the rear end of the plunger, the plunger is displaced in a direction toward the firing pin such that the plunger is disengaged from the aperture in the firing pin stop.

When the firing pin stop disengagement mechanism is in the unlocked position, the firing pin stop may be removed from the slide while the firing pin, firing pin spring and the plunger are secured in the slide. The firing pin, firing pin spring and the plunger then may be removed from the slide by again applying a force by a user on the exposed surface to raise the pawl.

A lever spring may be included that is secured in a groove in the slide, perpendicular to the sliding axis of the slide. The lever spring may be secured in the groove by a pivot pin disposed through a hole at the pivot point of the lever and through at least one pivot pin receiving aperture in the slide. The pivot pin may be accessible and removable at an end of the slide to provide for disassembly of the lever spring and pivoting lever from the slide.

In a broader embodiment of the present invention, a firing pin stop disengagement mechanism is provided to aid in removal of the firing pin stop for an automatic pistol. The pistol has a firing pin assembly mounted in a slide where the firing pin assembly is secured in the slide by the firing pin stop. The firing pin assembly includes a firing pin, a plunger and a firing pin spring secured between the firing pin and the plunge. The firing pin stop disengagement mechanism includes a pivoting lever having a first end having a pawl to engage a rear end of the plunger, a second end biased by a lever spring to cause the first end to move downward toward the plunger, and a pivot point located between the first end and the second end. The second end has an exposed surface adapted to receive a force by a user to raise the pawl from away from the plunger, whereby when the firing pin stop disengagement mechanism is in a unlocked position, the plunger is seated in an aperture in the firing pin stop and the firing pin is properly positioned for firing. When the firing pin stop disengagement mechanism is in an unlocked position, the pawl is engaged on the rear end of the plunger, the plunger is displaced in a direction toward the firing pin such that the plunger is disengaged from the aperture in the firing pin stop, and the firing pin stop may be removed from the slide while the firing pin, firing pin spring and the plunger are secured in the slide.

A method for removing a firing pin in a semi-automatic pistol is also provided which include first includes the step of providing the pistol having a frame, a slide, a firing pin assembly (including a firing pin, a plunger, and a firing pin spring secured between the firing pin and the plunger). This firing pin assembly of the pistol is mounted in the slide. A firing pin stop secures the firing pin assembly in the slide. The method continues with the step of providing a firing pin stop disengagement mechanism which includes the plunger which has a radial groove and a rear end, and a pivoting lever having a first end having a pawl to engage the radial groove in the plunger and the rear end of the plunger, and a second end biased by a lever spring in a direction to press the pawl toward the plunger. A pivot point is located between the first end and the second end. The second end has an exposed surface adapted to receive a force by a user to raise the pawl from away from the plunger. The method continues with the steps of disassembling the slide from the frame, applying a downward force to the exposed surface to cause the pawl of the pivoting lever to rise in an upward direction away from plunger, applying a force to the plunger to compress the firing pin spring to a position wherein the rear end of the plunger is adjacent to the pawl of the pivoting lever, and releasing the downward force to the exposed surface to cause the pawl of the pivoting lever, simultaneous to the step of applying the force to the plunger, to lower in a downward direction toward the rear end of the plunger to lock the plunger in a longitudinal position in the slide wherein the plunger is withdrawn from an aperture in the firing pin stop and wherein the plunger holds the firing pin assembly in position in the slide. The method continues with the additional steps of sliding the firing pin stop from the slide, and applying a downward force to the exposed surface to cause the pawl of the pivoting lever to rise in an upward direction away from the plunger to release the pawl from rear end of the plunger and thereby releasing the plunger, the firing pin spring, and firing pin from a firing pin aperture in the slide.

The method may continue with the additional steps of replacing the plunger, the firing pin spring and the firing pin in the aperture in the slide, and applying a force to the plunger to compress the firing pin spring to a position wherein the rear end of the plunger is adjacent to the pawl of the pivoting lever. A downward force is applied to the exposed surface simultaneous to the step of applying the force to the plunger to cause the pawl of the pivoting lever to rise in an upward direction away from plunger. The downward force to the exposed surface is then released to cause the pivoting lever to lower the pawl in a downward direction toward the plunger and against the rear end of the plunger to lock the plunger in a longitudinal position relative to the slide. Finally, the method may continue with the steps of sliding the firing pin stop into its proper position on the slide, and applying a downward force to the exposed surface to cause pawl of the pivoting lever to rise in an upward direction away from the plunger to release the pawl from the rear end of the plunger and thereby releasing the plunger causing the firing pin spring to press the plunger into its proper position in the aperture of the firing pin stop and causing the pawl to engage the radial groove of the plunger.

The step of providing the firing pin stop disengagement mechanism may include providing the lever spring secured in a groove in the slide, perpendicular to the sliding axis of the slide. Here, the lever spring may be secured in the groove by a pivot pin disposed through a hole at the pivot point of the lever and through at least one pivot pin receiving aperture in the slide. The pivot pin may be accessible and removable at an end of the slide to provide for disassembly of the lever spring and pivoting lever from the slide.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiments, but it should be understood that the present invention is not deemed to be limited thereto.

Figure 1:
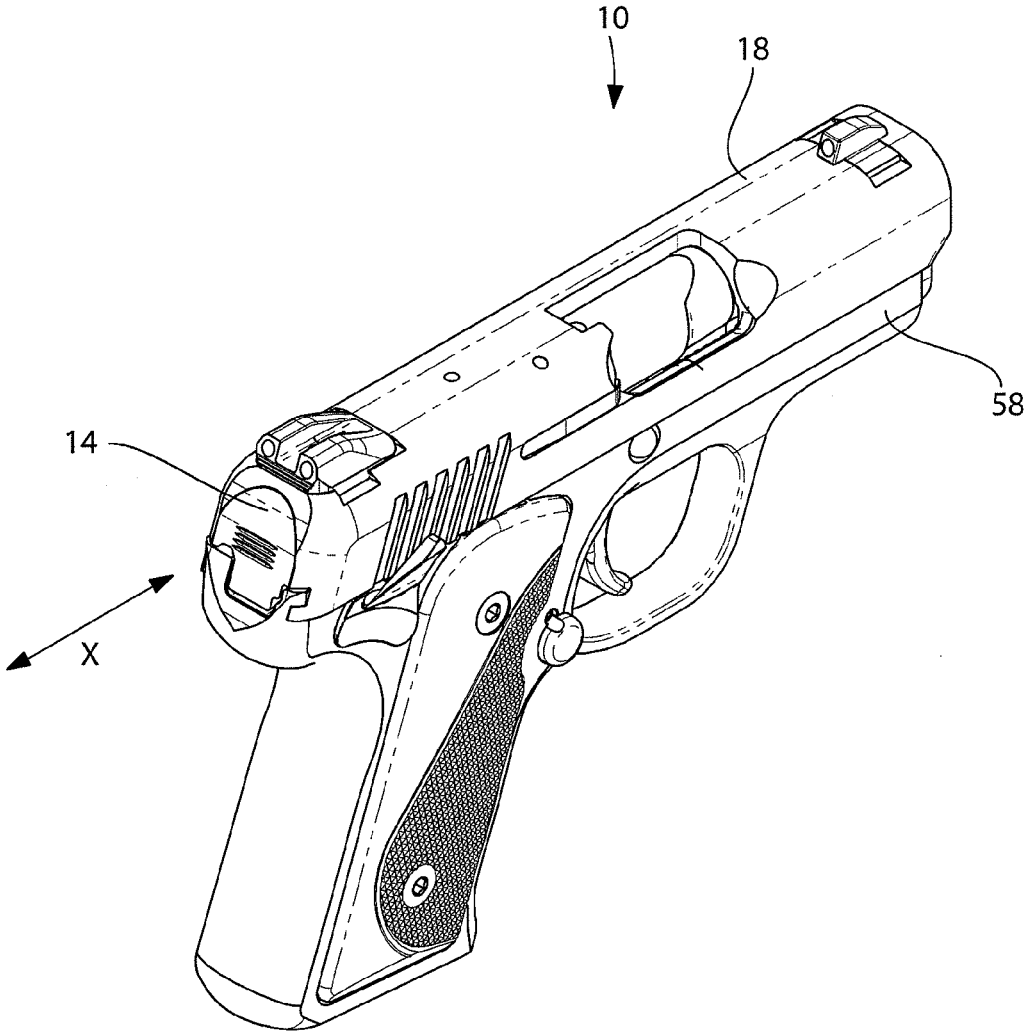
FIG. 1 is an isometric view of a pistol having a firing pin stop disengagement mechanism in accordance with a preferred embodiment of the present invention.
Figure 2:
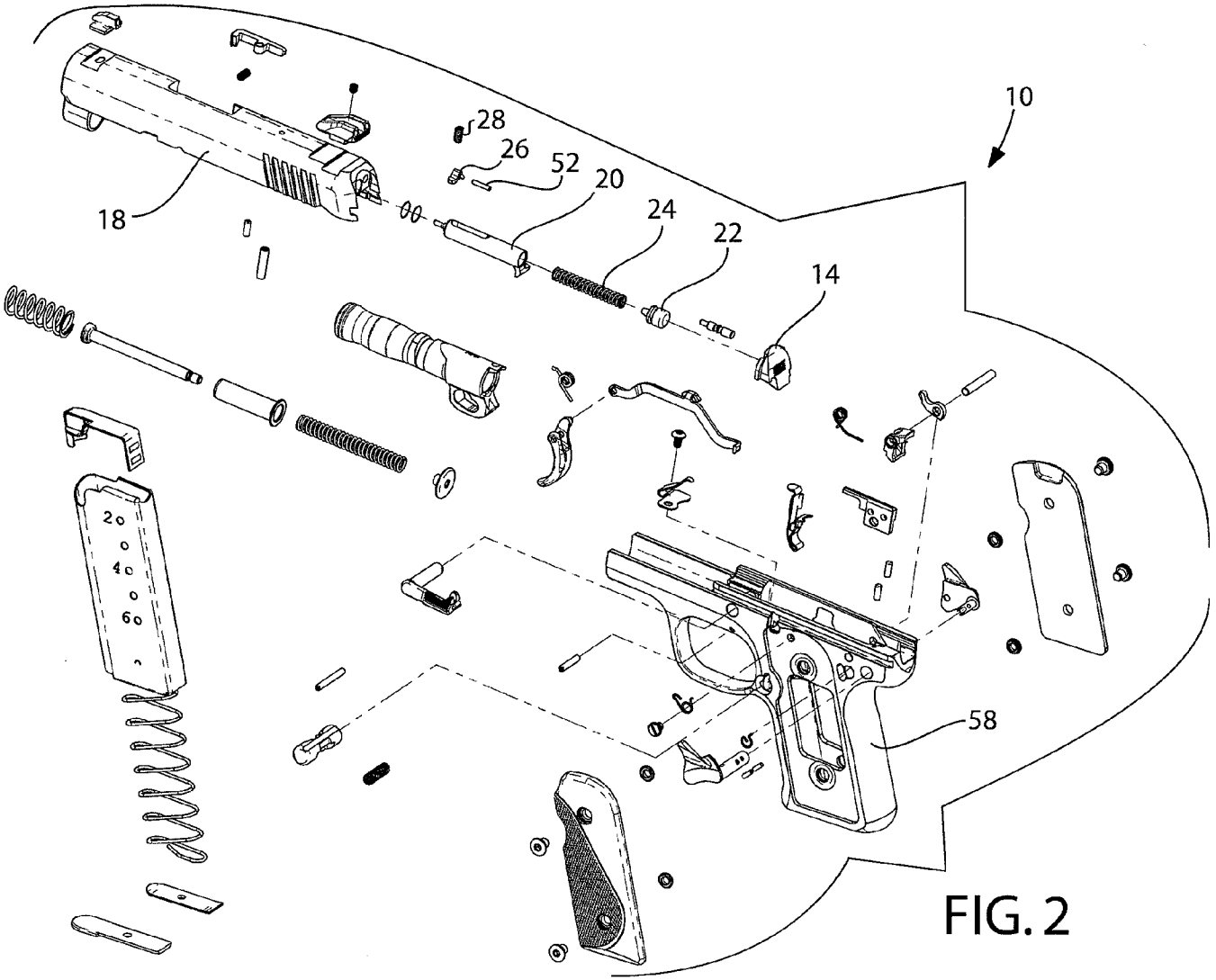
FIG. 2 is an exploded isometric view of the pistol having a firing pin stop disengagement mechanism of FIG. 1.
Figure 3:
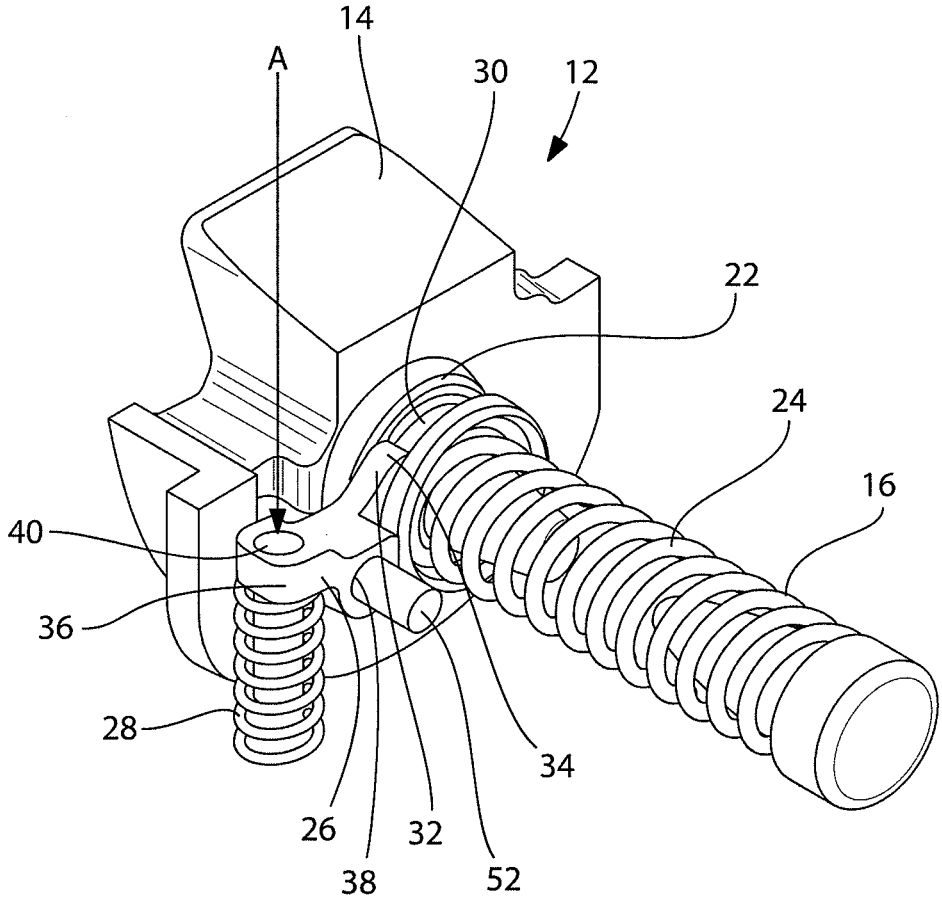
FIG. 3 is an isometric view of the firing pin stop disengagement mechanism of the pistol of FIG. 1, shown without a slide of the pistol, shown in a locked position.
Figure 4:
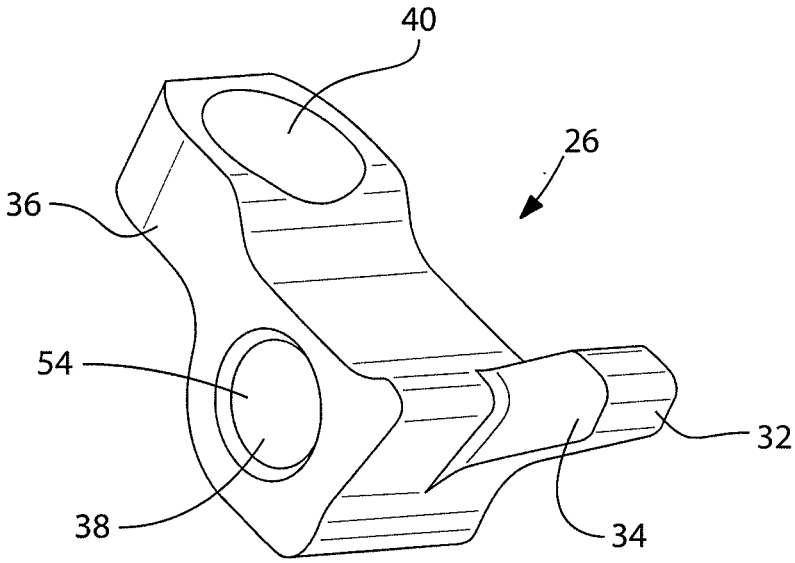
FIG. 4 is an isometric view of a pivoting lever of the firing pin stop disengagement mechanism of FIG. 3.
Figure 5:
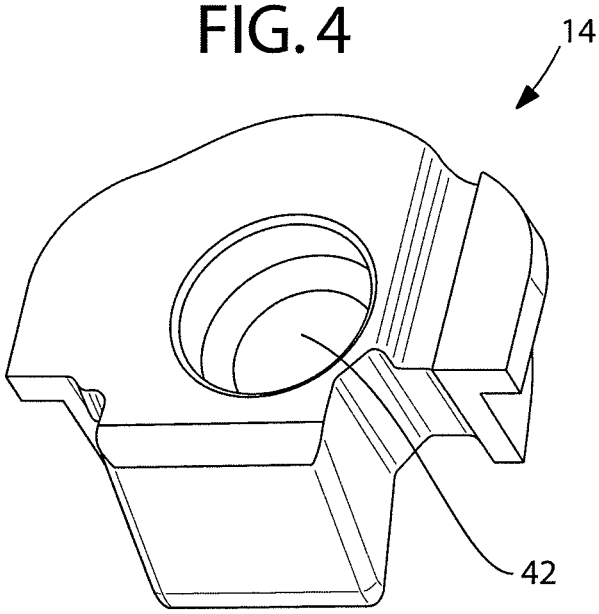
FIG. 5 is an isometric view of a firing pin stop of the firing pin stop disengagement mechanism of FIG. 3.
Figure 6:
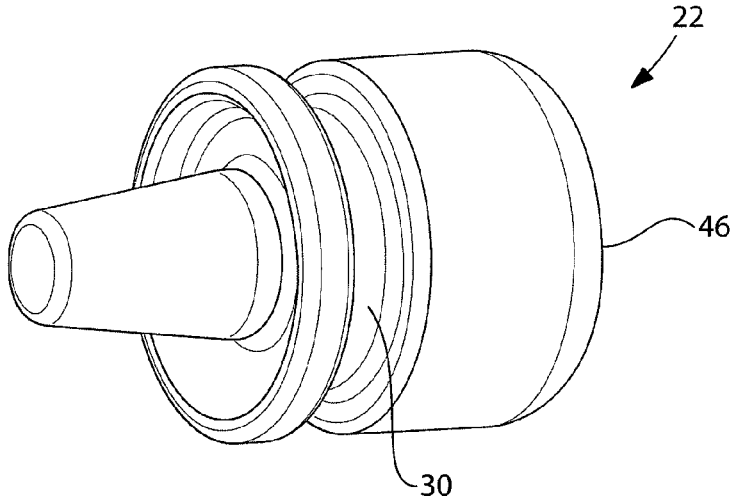
FIG. 6 is an isometric view of a plunger of the firing pin stop disengagement mechanism of FIG. 3.

Referring now to the drawings wherein like part numbers refer to like elements throughout the several views, there is shown in FIGS. 1 and 2, an automatic pistol 10 having a firing pin stop disengagement mechanism 12 in accordance with a first preferred embodiment of the present invention. The firing pin stop disengagement mechanism 12 aids in removal of the firing pin stop 14 of the automatic pistol 10, wherein the pistol 10 has a firing pin assembly 16 mounted in the slide 18 of the pistol 10. The firing pin assembly 16 is secured in the slide 18 by the firing pin stop 14. The firing pin assembly 16 includes a firing pin 20, a plunger 22 and a firing pin spring 24 secured between the firing pin 20 and the plunger 22.

The firing pin stop disengagement mechanism 12 and its various components are best seen in FIGS. 3-13 in locked and unlocked positions, as will be explained in detail below. As can be seen, for example, in FIG. 3, the elements of the firing pin stop disengagement mechanism 12 include the specially designed firing pin stop 14, also commonly known as a "back door" (see FIG. 5), a plunger 22 (see FIG. 6), a pivoting lever 26 (see FIG. 4), a lever spring 28 (see FIG. 3), and special elements of the slide 18 (see FIGS. 7-13).

Figure 11:
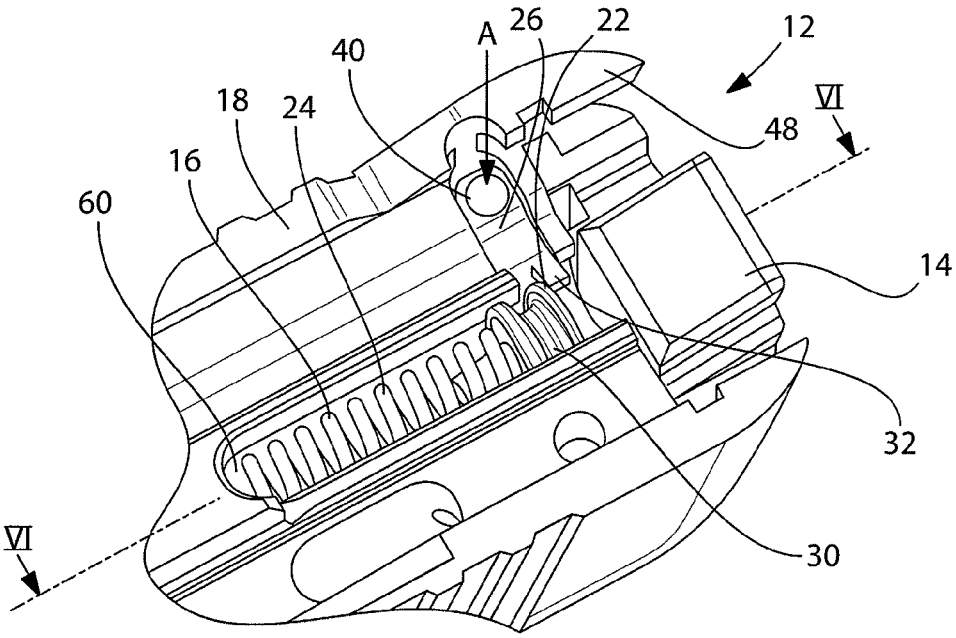
FIG. 11 is an isometric view of a firing pin stop disengagement mechanism of FIG. 3, shown with a portion of the slide of the pistol of FIG. 1, shown in an unlocked configuration, wherein the firing pin stop is removable from the slide.
Figure 12:
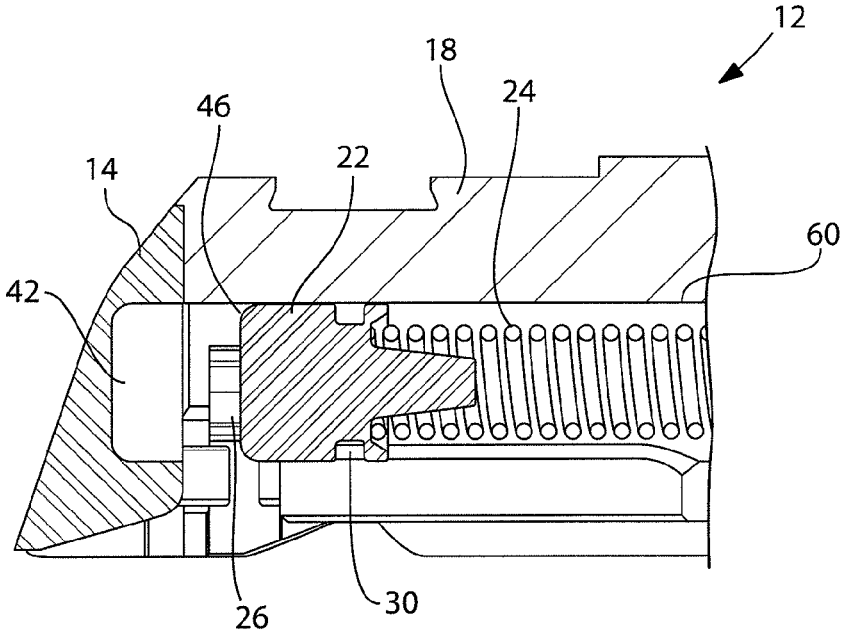
FIG. 12 is a cross-sectional view of the firing pin stop disengagement mechanism of FIG. 3, shown with a portion of the slide of the pistol of FIG. 1, taken along lines IV-IV of FIG. 11 shown in an unlocked configuration, wherein the firing pin stop is removable from the slide.
Figure 13:
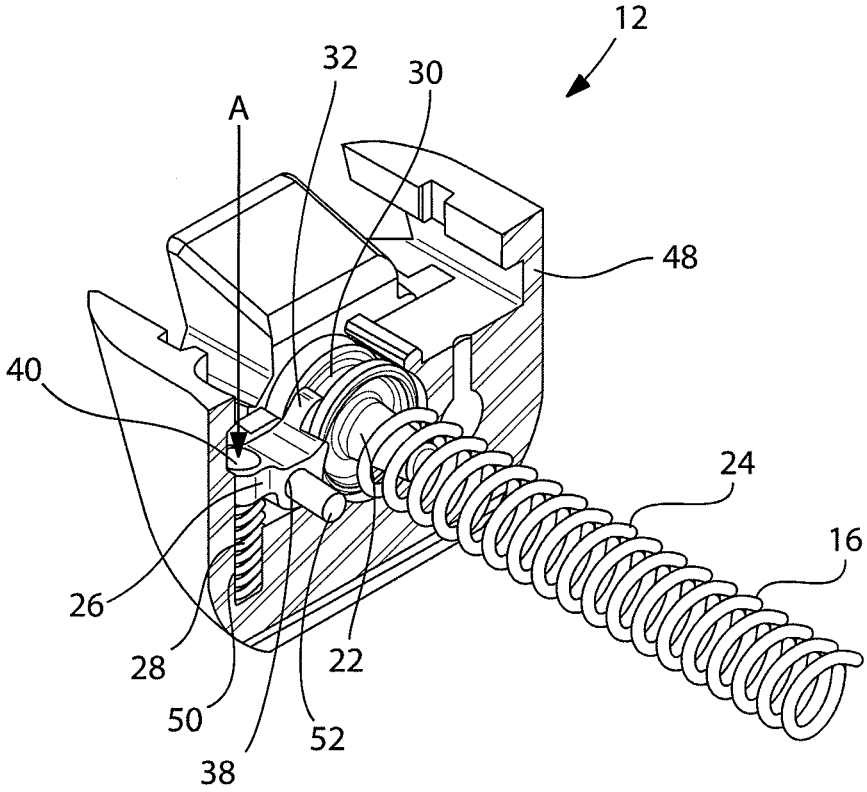
FIG. 13 is an isometric view of the firing pin stop disengagement mechanism of the pistol of FIG. 1, shown with a cross section of the slide, shown in a locked position, where the firing pin stop is not removable from the slide.

The firing pin stop disengagement mechanism 12 has two primary positions: a locked position where the firing pin stop disengagement mechanism 12 is in a position where the pistol 10 may be fired (see FIGS. 3, 8A, 8B, 9 and 13) and an unlocked position where the firing pin stop 14 of the firing pin stop disengagement mechanism 12 may be removed (see FIGS. 11 and 12). These two positions will be described below.

The plunger 22 has a radial groove 30 that accepts the pawl 32 of the pivoting lever 26. The pivoting lever 26 has a first end 34 having the pawl 32 to engage the radial groove 30 and a second end 36 biased by the lever spring 28 in a direction to press the pawl 32 towards the radial groove 30. The pivoting lever has a pivot point 38 located between the first end 34 and the second end 36. The second end 36 has an exposed surface 40 adapted to be pressed down in direction A (see FIGS. 3, 8A, 8B, 10A, 10B, 11 and 13) by a user to disengage the pawl 32 from the radial groove 30.

When the firing pin stop disengagement mechanism 12 is in a locked position, as shown in FIGS. 3, 8A, 8B 9, and 13, the pawl 32 is engaged in the radial groove 30 and the plunger 22 is seated in an aperture 42 in the firing pin stop 14. Here, the firing pin assembly 16, including firing pin 20, firing pin spring 24, plunger 22 and related elements are properly positioned for firing of the pistol 10.

To place the firing pin stop disengagement mechanism 12 in an unlocked position, a user presses exposed surface 40 in direction A to disengage the pawl 32 from the radial groove 30. Simultaneously, the user manually moves the plunger 22, using a flat screwdriver 44 or other relatively pointed tool in a direction B (see FIGS. 10A, 10B and 11) to compress the firing pin spring 24 toward the firing pin 20 such that the plunger 22 is disengaged from the aperture 42 in the firing pin stop 14. The user then releases the exposed surface 40 (moves opposite to direction A), wherein the edge of the pawl 32 engages the rear end 46 of the plunger 22 to hold the plunger 46 and the remaining elements of the firing pin assembly 16 in longitudinal position in the slide 18. The firing pin stop 14 may be removed from the slide 18 by sliding the firing pin stop 14 off of the slide 18 as is well known. The firing pin 20, the firing pin spring 24 and the plunger 22 are secured in the slide 18 by the pawl 32 bearing against the rear end 46 of the plunger 22.

Preferably, the lever spring 28 is secured in a groove 50 in the slide 18, perpendicular to the sliding axis of the slide 18. Additionally, the lever spring 28 may be secured in the groove 50 by a pivot pin 52 disposed through a hole 54 at the pivot point 38 of the pivoting lever 26 and through at least one pivot pin receiving aperture 56 in the slide 18. Here, preferably, the pivot pin 52 is accessible to a user (once the slide 18 is removed from the frame 58) such that it may be manually removed along with the lever spring 28 and the pivoting lever 26 for cleaning and repair.

A method for removing a firing pin stop 14 in a semi-automatic pistol 10 is also disclosed. The method first includes the step of providing the pistol 10 having a frame 58, a slide 14, a firing pin assembly 16 (including a firing pin 20, a plunger 22, and a firing pin spring 24 secured between the firing pin 20 and the plunger 22). The firing pin assembly 16 is mounted in the slide 18, and a firing pin stop 14 secures the firing pin assembly 16 in the slide 18, as described above. The method continues with the step of providing a firing pin stop disengagement mechanism 12 which includes a radial groove 30 in the plunger 22 and a pivoting lever 26. The pivoting lever 26 has a first end 34 having a pawl 32 to engage the radial groove 30 in the plunger 22, a second end 36 biased by a lever spring 28 in a direction to press the pawl 32 into the radial groove 30, and a pivot point 38 located between the first end 34 and the second end 36. The second end 36 has an exposed surface 40 adapted to receive a force by a user (direction A), i.e., be pressed down by a user using, for example, a screwdriver tip, to disengage the pawl 32 from the radial groove 30. The method continues with the steps of disassembling the slide 18 from the frame 58 (by sliding the slide from the frame 58 along tracks 48) and applying a downward force (in direction A) to the exposed surface 40 to cause the pawl 32 of the pivoting lever 26 to raise in an upward direction away from the plunger 22 and the firing pin assembly 16. The method further continues with the steps of applying a force (in direction B) to the radial groove 30 of the plunger 22 (using, for example, a flat screwdriver 44 in radial groove 30 of the plunger 22 in direction B) to compress the firing pin spring 24 to a position wherein the radial groove 30 is at a position adjacent to the rear end 46 of the plunger 22 and releasing the downward force to the exposed surface 40 to cause the lever spring 28 to lower the pawl 32 of the pivoting lever 26 to capture the rear end 46 of the plunger 22 in its longitudinal position in the slide 18. The steps of applying the downward force in direction A to the exposed surface 40 is simultaneous to the step of applying the force to the plunger 22 in direction B. The method continues with the step of sliding the firing pin stop 14 from the slide 18. Now, a downward force may be applied in direction A to the exposed surface 40 of the pivot lever to cause the pawl 32 of the pivoting lever 26 to raise in an upward direction away from the plunger 22 thereby releasing the plunger 22, the firing pin spring 24, and firing pin 20 from a firing pin aperture 60 in the slide 18.

The method may include additional steps to replace the firing pin stop 14 and firing pin assembly 16 back in proper position. These additional steps include replacing the plunger 22, the firing pin spring 24 and the firing pin 20 in the aperture 60 in the slide 18, applying a force to the plunger 22 in direction B, using, for example, a flat screwdriver 44 in the radial groove 30 of the plunger 22 to compress the firing pin spring 24 to a position wherein the rear end 46 of the plunger 22 is adjacent to the pawl 32 of the pivoting lever 26, applying a downward force in direction A to the exposed surface 40 simultaneous to the step of applying an the force in direction B to the plunger 22 to cause the pawl 32 of the pivoting lever 26 to raise in an upward direction away from plunger 22 (direction B), and releasing the downward force to the exposed surface 40 to cause the pawl 32 of the pivoting lever 26 to lower in a downward direction toward the plunger 22 to lock the plunger 22 in a longitudinal position relative to the slide 18. The additional steps then include sliding the firing pin stop 14 into its proper position on the slide 18, and applying a downward force (direction A) to the exposed surface 40 to cause pawl 32 of the pivoting lever 26 to raise in an upward direction away from the rear end 46 of the plunger 22 thereby releasing the plunger 22 causing the firing pin spring 24 to press the plunger 22 into its proper position in the aperture 42 of the firing pin stop 14.

Figure 7:
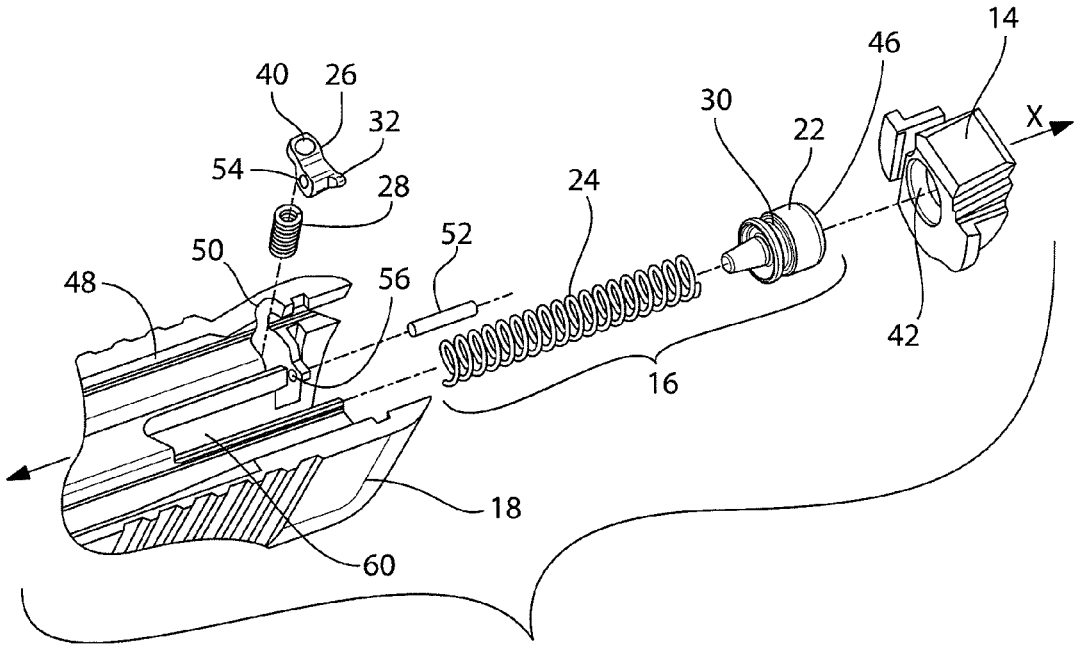
FIG. 7 is an exploded isometric view of the firing pin stop disengagement mechanism of FIG. 3, shown with a portion of a slide of the pistol of FIG. 1.
Figure 8A:
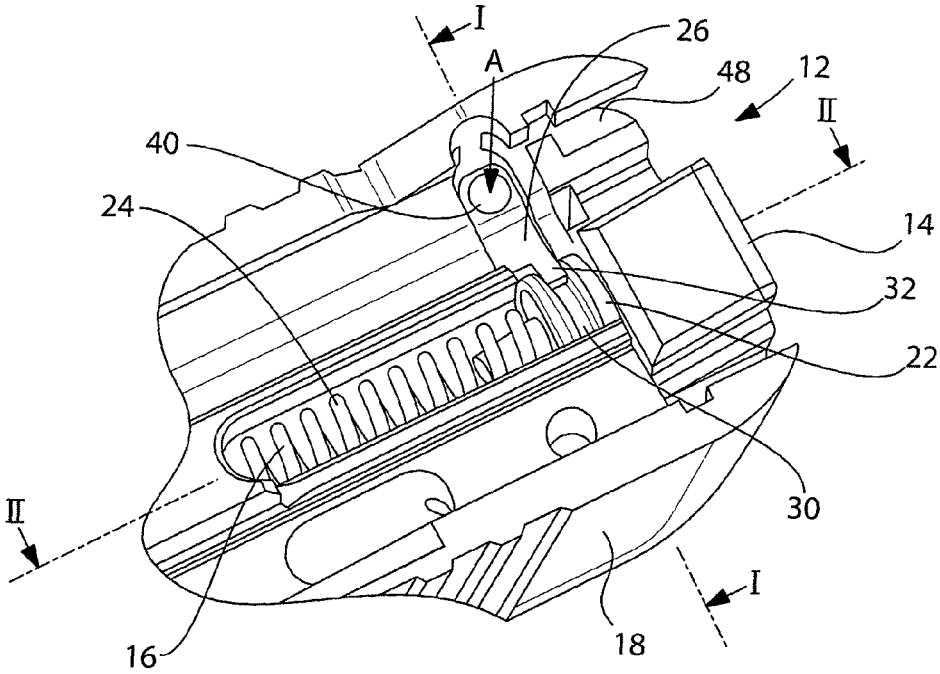
FIG. 8A is an isometric view of a firing pin stop disengagement mechanism of FIG. 3, shown with a portion of the slide of the pistol of FIG. 1, shown in a locked configuration, wherein the firing pin stop is not removable from the slide.
Figure 8B:
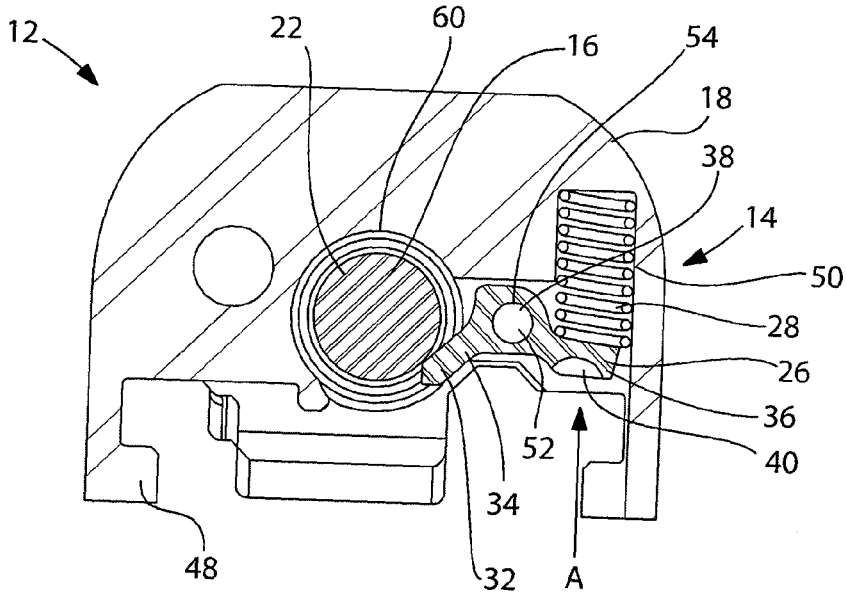
FIG. 8B is a cross-sectional view of the firing pin stop disengagement mechanism of FIG. 3, shown with the slide of the pistol of FIG. 1, taken along lines I-I of FIG. 8A, shown in a locked configuration, wherein the firing pin stop is not removable the slide.
Figure 9:
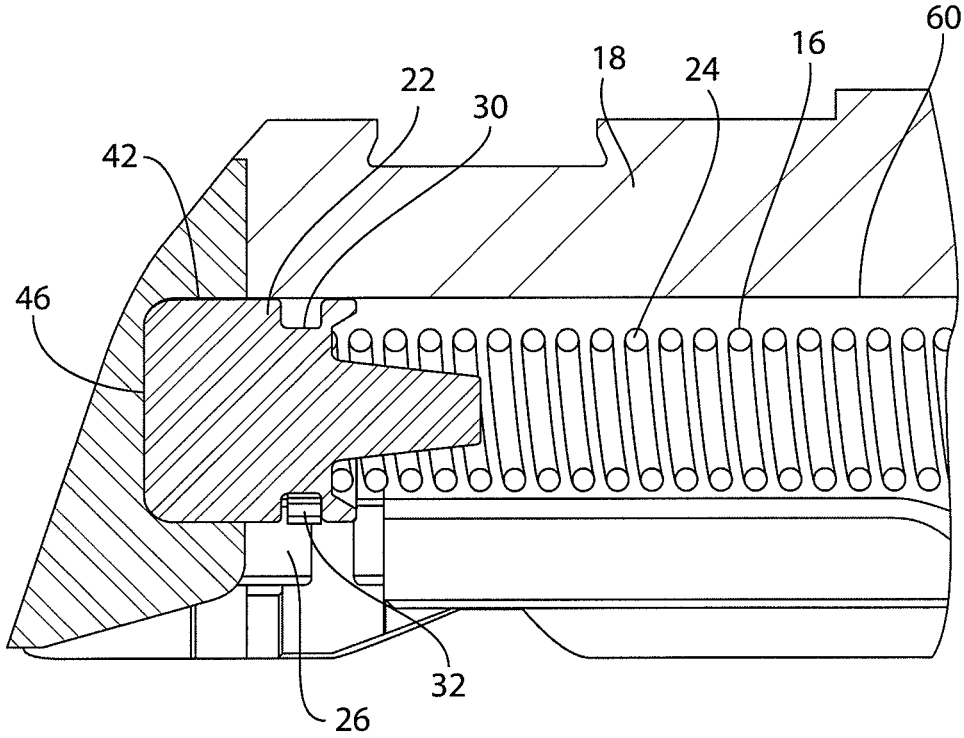
FIG. 9 is a cross-sectional view of the firing pin stop disengagement mechanism of FIG. 3, shown with a portion of the slide of the pistol of FIG. 1, taken along lines II-II of FIG. 8A, shown in a locked configuration, wherein the firing pin stop is not removable the slide.
Figure 10A:
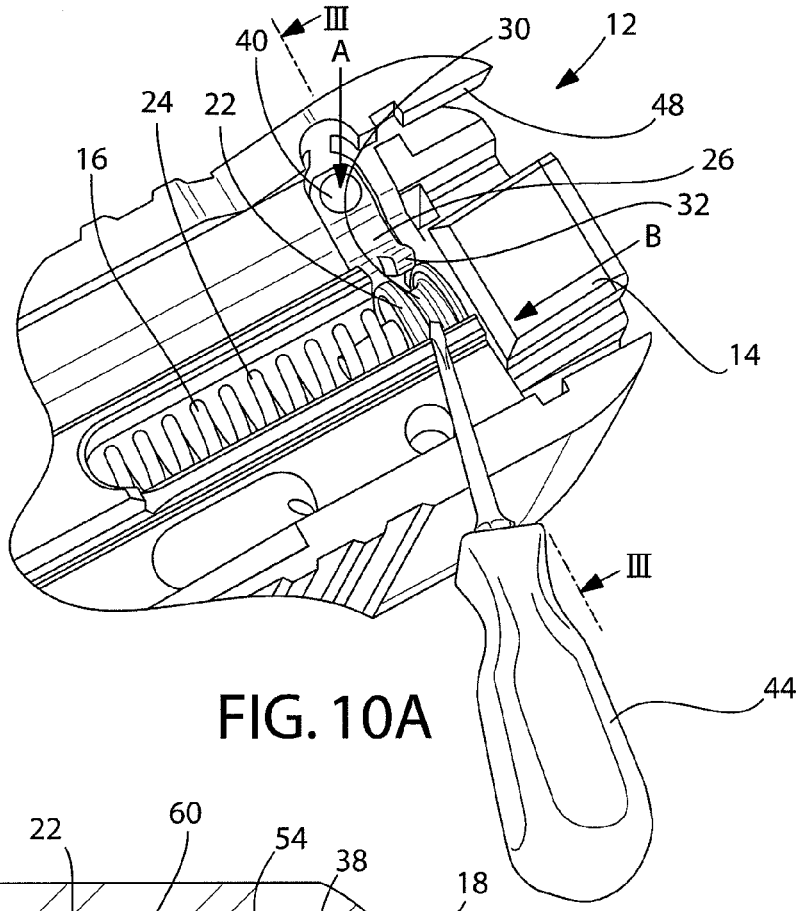
FIG. 10A is an isometric view of a firing pin stop disengagement mechanism of FIG. 3, shown with a portion of the slide of the pistol of FIG. 1, shown in an unlocked configuration, but prior to manual movement of the plunger away from the firing pin stop.
Figure 10B:
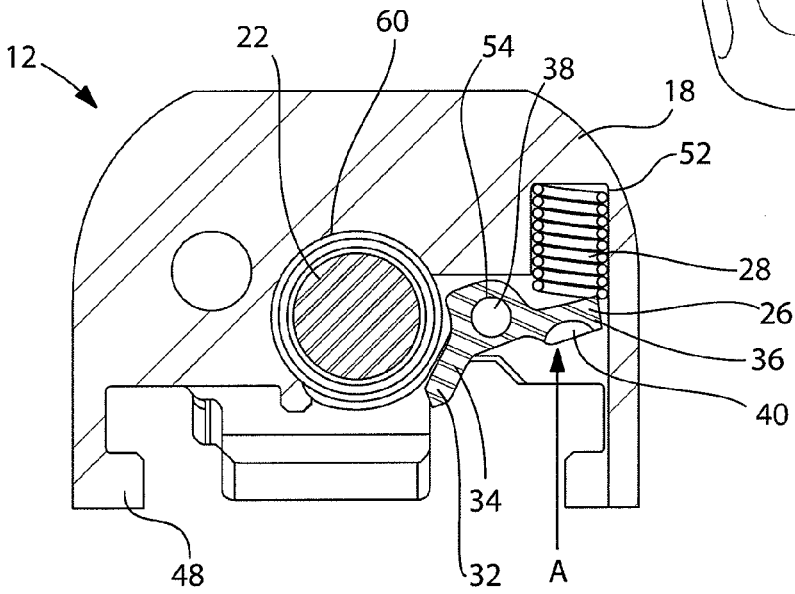
FIG. 10B is a cross-sectional view of the firing pin stop disengagement mechanism of FIG. 3, shown with the slide of the pistol of FIG. 1, taken along lines III-III of FIG. 10A, shown in an unlocked configuration, but prior to manual movement of the plunger away from the firing pin stop.

The step of providing the firing pin stop disengagement mechanism 12 may include providing the lever spring 28 secured in a groove 50 in the slide 18, perpendicular to the sliding axis X of the slide (see FIGS. 7, 8B and 10B). The lever spring 29 may be secured in the groove 50 by the pivot pin 52 disposed through a hole 54 at the pivot point 38 of the pivoting lever 26 and through at least one pivot pin receiving aperture 56 in the slide. Finally, the method may include removing a pivot pin 52 that is accessible at an end of the slide 14 to provide for disassembly of the lever spring 28 and pivoting lever 26 from the slide 18.

While the invention has been described in detail and with reference to specific examples thereof, it will be apparent to one skilled in the art that various changes and modifications can be made therein without departing from the spirit and scope thereof.

What is claimed is:

1. A firing pin stop disengagement mechanism to aid in removal of the firing pin stop for an automatic pistol having a firing pin assembly mounted in a slide, the firing pin assembly secured in said slide by the firing pin stop, the firing pin assembly comprising a firing pin, a plunger and a firing pin spring secured between the firing pin and the plunger, the firing pin stop disengagement mechanism comprising:

(a) the plunger having a radial groove and a rear end; and (b) a pivoting lever having a first end having a pawl to engage the radial groove of the plunger and the rear end of the plunger, a second end biased by a lever spring to cause the first end to move downward toward the plunger, and a pivot point located between the first end and the second end, the second end having an exposed surface adapted to receive a force by a user to raise the pawl away from the plunger;

whereby when the firing pin stop disengagement mechanism is in a locked position, the pawl is engaged in the radial groove and the plunger is seated in an aperture in the firing pin stop and the firing pin is properly positioned for firing, and when the firing pin stop disengagement mechanism is in an unlocked position, the pawl is engaged on the rear end of the plunger, the plunger is displaced in a direction toward the firing pin such that the plunger is disengaged from the aperture in the firing pin stop, such that the firing pin stop may be removed from the slide while the firing pin, firing pin spring and the plunger are secured in the slide.

2. The firing pin stop disengagement mechanism of claim 1, wherein the lever spring is secured in a groove in the slide, perpendicular to a sliding axis of the slide.

3. The firing pin stop disengagement mechanism of claim 2, wherein the lever spring is secured in the groove by a pivot pin disposed through a hole at the pivot point of the lever and through at least one pivot pin receiving aperture in the slide.

4. The firing pin stop disengagement mechanism of claim 3, wherein the pivot pin is accessible and removable at an end of the slide to provide for disassembly of the lever spring and pivoting lever from the slide.

5. A firing pin stop disengagement mechanism to aid in removal of the firing pin stop for an automatic pistol having a firing pin assembly mounted in a slide, the firing pin assembly secured in said slide by the firing pin stop, the firing pin assembly comprising a firing pin, a plunger and a firing pin spring secured between the firing pin and the plunger, the firing pin stop disengagement mechanism comprising a pivoting lever having a first end having a pawl to engage a rear end of the plunger, a second end biased by a lever spring to cause the first end to move downward toward the plunger, and a pivot point located between the first end and the second end, the second end having an exposed surface adapted to receive a force by a user to raise the pawl away from the plunger, whereby when the firing pin stop disengagement mechanism is in a unlocked position, the plunger is seated in an aperture in the firing pin stop and the firing pin is properly positioned for firing, and when the firing pin stop disengagement mechanism is in an unlocked position, the pawl is engaged on the rear end of the plunger, the plunger is displaced in a direction toward the firing pin such that the plunger is disengaged from the aperture in the firing pin stop, and the firing pin stop may be removed from the slide while the firing pin, firing pin spring and the plunger are secured in the slide.

6. A method for removing a firing pin in a semi-automatic pistol, comprising:

(a) providing the pistol having a frame, a slide, a firing pin assembly comprising a firing pin, a plunger, and a firing pin spring secured between the firing pin and the plunger, the firing pin assembly mounted in the slide, and a firing pin stop to secure the firing pin assembly in the slide;

(b) providing a firing pin stop disengagement mechanism, comprising:

(i) the plunger having a radial groove and a rear end; and (ii) a pivoting lever having a first end having a pawl to engage the radial groove in the plunger and the rear end of the plunger, a second end biased by a lever spring in a direction to press the pawl toward the plunger, and a pivot point located between the first end and the second end, the second end having an exposed surface adapted to receive a force by a user to raise the pawl away from the plunger;

(c) disassembling the slide from the frame;

(d) applying a downward force to the exposed surface to cause the pawl of the pivoting lever to rise in an upward direction away from plunger;

(e) applying a force to the plunger to compress the firing pin spring to a position wherein the rear end of the plunger is adjacent to the pawl of the pivoting lever;

(f) releasing the downward force to the exposed surface to cause the pawl of the pivoting lever, simultaneous to the step of applying the force to the plunger, to lower in a downward direction toward the rear end of the plunger to lock the plunger in a longitudinal position in the slide wherein the plunger is withdrawn from an aperture in the firing pin stop and wherein the plunger holds the firing pin assembly in position in the slide;

(g) sliding the firing pin stop from the slide; and (h) applying a downward force to the exposed surface to cause the pawl of the pivoting lever to rise in an upward direction away from the plunger to release the pawl from rear end of the plunger and thereby releasing the plunger, the firing pin spring, and firing pin from a firing pin aperture in the slide.

7. The method for removing a firing pin in a semi-automatic pistol of claim 6, comprising the additional steps of:

(a) replacing the plunger, the firing pin spring and the firing pin in the aperture in the slide;

(b) applying a force to the plunger to compress the firing pin spring to a position wherein the rear end of the plunger is adjacent to the pawl of the pivoting lever;

(c) applying a downward force to the exposed surface simultaneous to the step of applying the force to the plunger to cause the pawl of the pivoting lever to rise in an upward direction away from plunger;

(d) releasing the downward force to the exposed surface to cause the pivoting lever to lower the pawl in a downward direction toward the plunger and against the rear end of the plunger to lock the plunger in a longitudinal position relative to the slide;

(e) sliding the firing pin stop into its proper position on the slide; and (f) applying a downward force to the exposed surface to cause pawl of the pivoting lever to rise in an upward direction away from the plunger to release the pawl from the rear end of the plunger and thereby releasing the plunger causing the firing pin spring to press the plunger into its proper position in the aperture of the firing pin stop and causing the pawl to engage the radial groove of the plunger.

8. The method for removing a firing pin in a semi-automatic pistol of claim 6, wherein the step of providing the firing pin stop disengagement mechanism includes providing the lever spring secured in a groove in the slide, perpendicular to a sliding axis of the slide.

9. The method for removing a firing pin in a semi-automatic pistol of claim 8, wherein the lever spring is secured in the groove by a pivot pin disposed through a hole at the pivot point of the lever and through at least one pivot pin receiving aperture in the slide.

10. The method for removing a firing pin in a semi-automatic pistol of claim 9, wherein the pivot pin is accessible and removable at an end of the slide to provide for disassembly of the lever spring and pivoting lever from the slide.

* * * * *